US007243711B2

(12) United States Patent
Amstutz et al.

(10) Patent No.: US 7,243,711 B2
(45) Date of Patent: Jul. 17, 2007

(54) EFFICIENT HEAT EXCHANGER AND ENGINE USING SAME

(75) Inventors: Aaron Amstutz, Princeville, IL (US); Thomas E. Brindle, Cooleemee, NC (US); Timothy A. Bruce, Peoria, IL (US); Bruce Hershock, Morgantown, NC (US); Sandra L. Ketcherside, Pekin, IL (US); John A. Nelson, Hickory, NC (US); Dan A. Piterski, Conover, NC (US); James L. Tilson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 488 days.

(21) Appl. No.: 10/813,282

(22) Filed: Mar. 30, 2004

(65) Prior Publication Data

US 2005/0217835 A1 Oct. 6, 2005

(51) Int. Cl.
*F28F 9/22* (2006.01)

(52) U.S. Cl. ..... 165/159; 165/DIG. 416

(58) Field of Classification Search ..... 165/159, 165/161

See application file for complete search history.

(56) References Cited

U.S. PATENT DOCUMENTS 3,351,131 A * 11/1967 Berthold ..... 165/159
3,656,548 A * 4/1972 Donaldson ..... 165/159
3,958,630 A * 5/1976 Smith ..... 165/161
4,016,929 A * 4/1977 Pfluger et al. ..... 165/159
5,048,596 A * 9/1991 Lu ..... 165/41
5,251,693 A * 10/1993 Zifferer ..... 165/160
6,840,306 B2 * 1/2005 Mota et al. ..... 165/76

FOREIGN PATENT DOCUMENTS

GB 2213922 A * 8/1989
JP 59137787 A * 8/1984

* cited by examiner

*Primary Examiner*—Allen J. Flanigan
(74) *Attorney, Agent, or Firm*—Liell & McNeil

(57) ABSTRACT

Some engine applications place spatial constraints on heat exchangers, such as oil coolers. In such a case, a heat exchanger having an oblong rather than a circular cross section can satisfy spatial constraints, and with certain internal geometry, may permit improved heat rejection performance while potentially enabling a cost reduction through a reduction in materials. The heat exchanger has a housing which defines a heat exchanging cavity within which a tube bundle is positioned. The tube bundle is made up of a plurality of tubes in a hexagonal packing pattern that are supported by a plurality of baffles. The tube bundle and the housing define a serpentine flow path between an inlet and an outlet. The serpentine flow path includes a plurality of segments that are generally perpendicular to the tubes, and these segments are separated by flow direction changing windows. The tube bundle has a gap distance at the windows that is relatively large, and a gap distance away from the windows that is relatively small. In addition, each of the tubes of the tube bundle is adjacent to at least three other tubes, such that the perimeter set of tubes creates a hexagonal shape.

19 Claims, 4 Drawing Sheets

EFFICIENT HEAT EXCHANGER AND ENGINE USING SAME

TECHNICAL FIELD

The present disclosure relates generally to heat exchangers, and more particularly to a new geometry for engine oil coolers.

BACKGROUND

Heat exchangers have for a variety of applications that are well known, and can include a number of different forms. For instance, oil coolers for internal combustion engines often take the form of a cylindrical housing that contains a tube bundle with a generally cylindrical cross section. The tubes are often packed in a hexagonal pattern such that each tube is surrounded by up to six other tubes in a pattern well known in the art. The tube bundle is often supported by baffles that are arranged in the housing to create a serpentine flow path between the inlet to the housing and the outlet. While many heat exchangers of this form have been produced for years and have performed well, there remains room for improvement.

One potential problematic area lies with constructing a heat exchanging oil cooler according to the conventional wisdom, which includes a circular cross section tube bundle housed in a cylindrical housing. The problem relates to ensuring adequate heat exchanging capacity, while fitting the oil cooler within an available space envelope with regard to a specific engine application. In other words, some newer engine applications can place substantial limitations on the available space for an oil cooler to occupy, while still meeting oil cooling performance requirements and pressure drop requirements.

Another potential issue that is often on the minds of design engineers relates to how to improve heat exchanging performance while simultaneously reducing costs. Those skilled in the art will appreciate that cost can be reduced in a number of ways, including a reduction in materials, simplification in manufacturing techniques, and other factors known in the art. Strategies for improving heat exchanging performance remains elusive, and these problems are compounded by ever present pressures to reduce or hold the line on cost.

The present invention is directed to overcoming one or more of the problems set forth above.

SUMMARY OF THE DISCLOSURE

In one aspect, the heat exchanger includes a housing having an annular internal wall that defines a portion of a heat exchanging cavity. A tube bundle, which includes a plurality of tubes and baffles, is positioned in the housing. The internal wall and the tube bundle define a serpentine flow path that includes a plurality of flow direction changing windows. The plurality of tubes include a perimeter set of tubes that define a bundle perimeter that is separated from the internal wall by a window distance at the windows, and separated from a gap distance away from the windows. The window distance is greater than the gap distance.

In another aspect, a heat exchanger includes a housing having an annular internal wall that defines a portion of a heat exchanging cavity. A tube bundle, which includes a plurality of tubes and a plurality of baffles, is positioned in the housing. The tube bundle is such that each of the tubes is adjacent to at least three other tubes. The internal wall and the tube bundle define a serpentine flow path that includes a plurality of flow direction changing windows. The plurality of tubes includes a perimeter set of tubes that define a bundle perimeter that is separated from the internal wall by a window distance at the windows and separated by a gap distance away from the windows.

DETAILED DESCRIPTION

Figure 1:
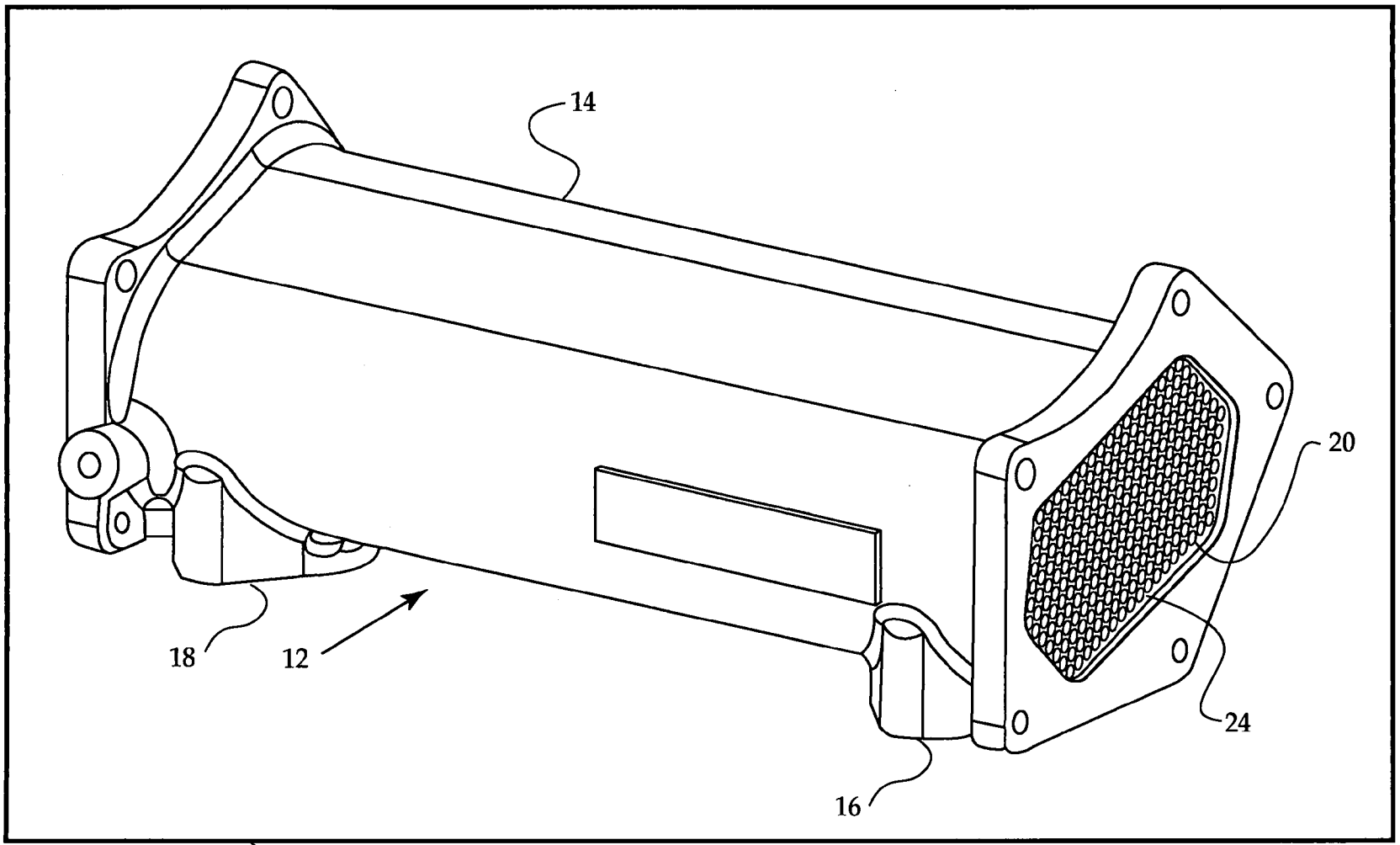
FIG. 1 is an isometric diagrammatic view of an engine with a heat exchanger according to the present disclosure.

Referring now to FIG. 1, an engine 10 includes a heat exchanger 12 that performs the function of an oil cooler. Heat exchanger 12 includes housing 14 with an inlet 16 and an outlet 18. In addition, a tube bundle 20 is mounted within a heat exchanging cavity defined by housing 14. The tubes carry a coolant fluid of a type well known in the art. In other words, hot oil enters at inlet 16 and travels a serpentine path 25 (FIG. 3) along tube bundle 20, and exits at a lower temperature at outlet 18. Although the present invention is illustrated in the context of a oil cooler for an engine, those skilled in the art will appreciate the present disclosure finds potential application to any heat exchanger that includes a tube bundle mounted in a housing 14 to define a serpentine flow path 25 between an inlet and an outlet. Housing 14 can be made in any suitable manner known in the art out of a suitable material. In the case of the preferred embodiment illustrated, the housing is preferably formed from cast aluminum, and then machined to arrive at the final form shown.

Figure 2:
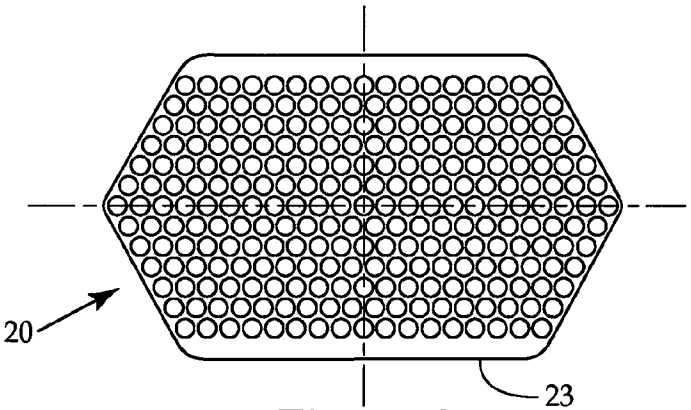
FIG. 2 is an end diagrammatic view of the tube bundle for the heat exchanger of FIG. 1.
Figure 3:
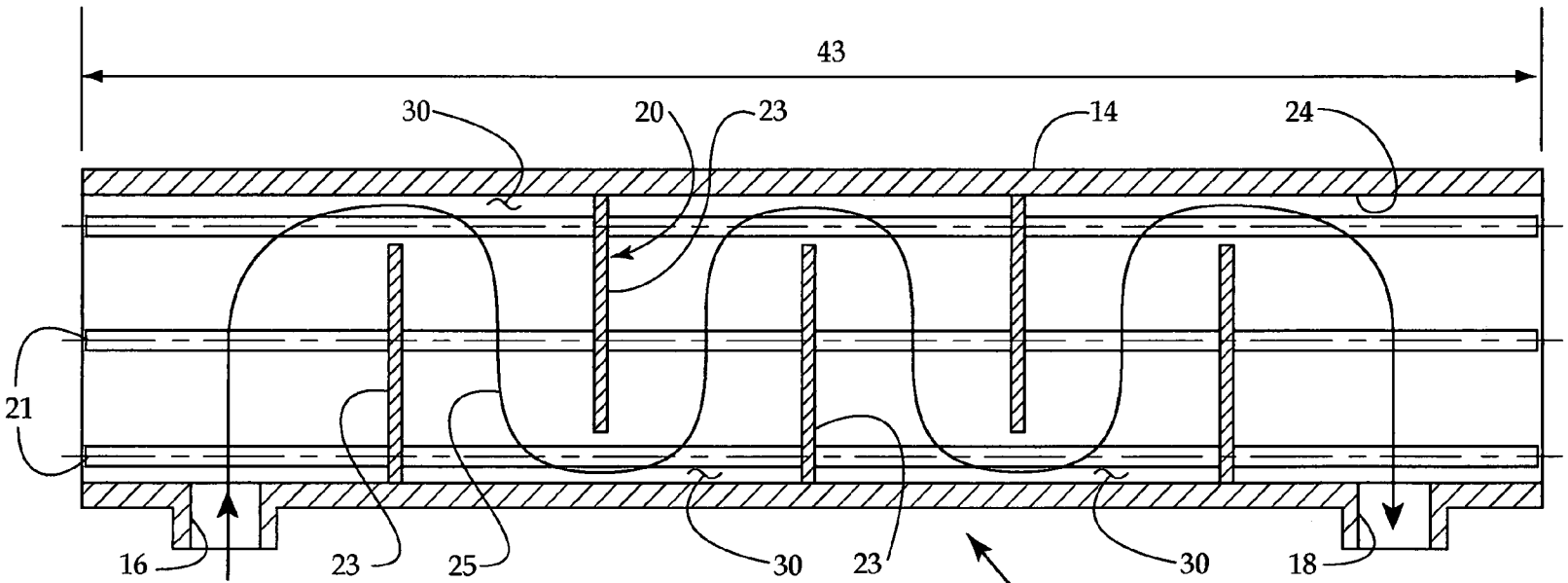
FIG. 3 is a front sectioned diagrammatic view of the heat exchanger of FIG. 2 as viewed along sectioned lines A—A of FIG. 4.
Figure 4:
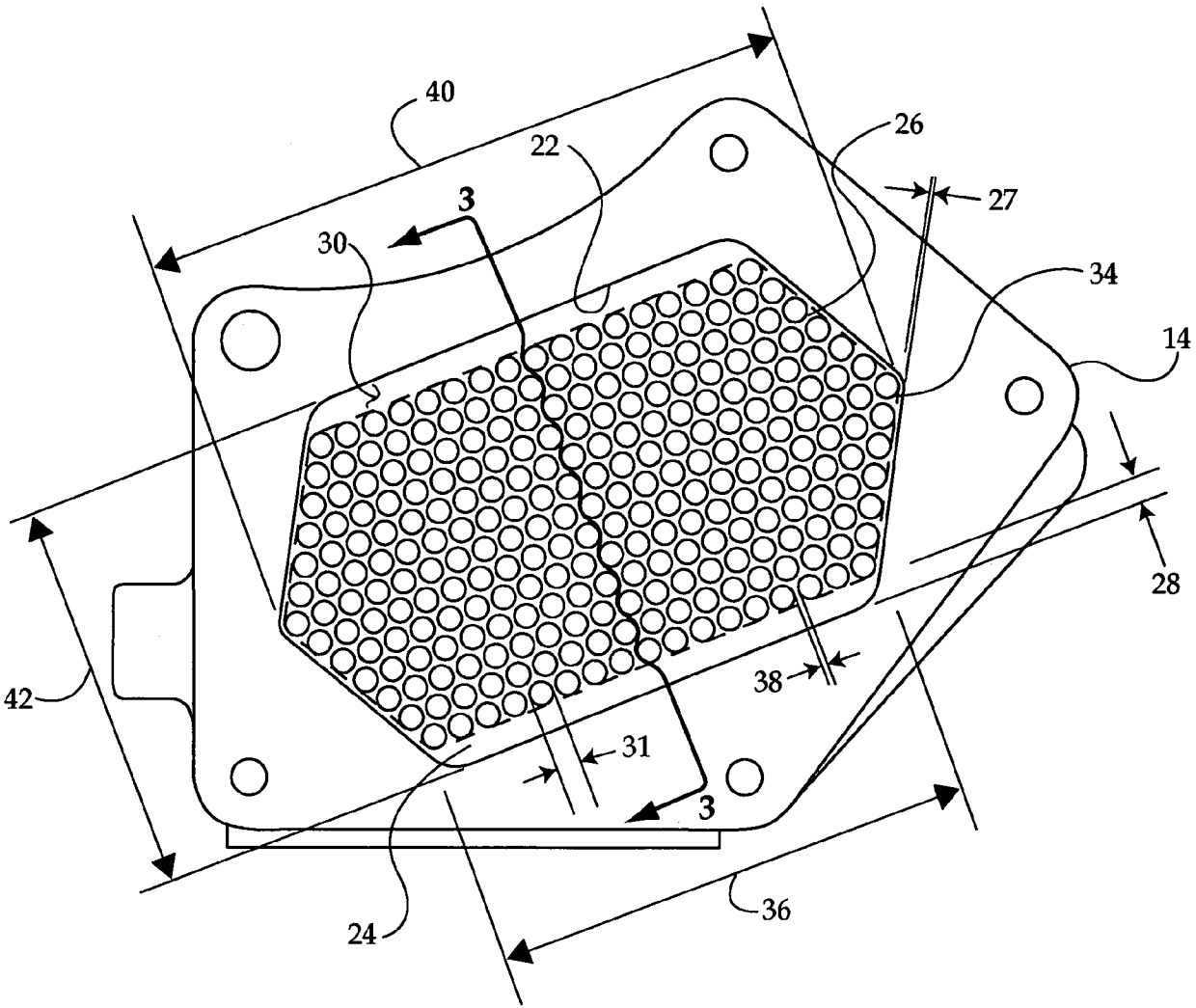
FIG. 4 is an end diagrammatic view of the heat exchanger of FIG. 1.

Referring in addition to FIGS. 2–4, in this specific example, tube bundle 20 includes one hundred forty copper tubes 21 mounted to five baffles 23 in the elongated hexagonal cross sectional shape shown in FIG. 2. Other known tube materials could be substituted as necessary or desirable. When tube bundle 20 is mounted in housing 14, a serpentine flow path 25 begins at inlet 16 and ends at outlet 18. The serpentine flow path 25 includes segments that run roughly perpendicular to tubes 21, and these segments are separated by flow direction changing windows 30. Thus, the housing can be thought of as defining a heat exchanging cavity 24, within which the tube bundle 20 is positioned. The ends of the housing 14 along with the ends of tubes 21 are sealed in a conventional manner.

Referring in particular to FIG. 4, housing 14 includes an annular internal wall 22 that is substantially uniform along its cavity length 43 (FIG. 3). Annular internal wall 22 has a shape sized to slideably receive tube bundle 20. Thus, heat exchanging cavity 24 can be thought of as having a cavity length 43 with a uniform cross section having a cavity width 40 and a cavity height 42, which is smaller than the width 43. This geometry, and other geometrical features of heat exchanger 10, are aspects of the present disclosure. For instance, the plurality of tubes 21 can be thought of as including a perimeter set of tubes 26 that define a bundle perimeter that is separated from the internal wall 22 of housing 14 by a window distance 28, at the flow direction changing windows 30, and by a gap distance 27 away from the windows. The window distance is preferably greater than the gap distance. Usually, the window distance 28 is at least several times that of gap distance 27. Preferably, the window distance is such that a cross section of the serpentine flow path 25 at the windows can accommodate the flow without creating a flow restriction that could undermine performance, such as by increasing a pressure drop through the heat exchanger 12. In the preferred embodiment illustrated, the gap distance 27 is uniform for a segment of the bundle perimeter 26 that corresponds to a plurality of adjacent tubes of the perimeter set of tubes 26. Preferably, the gap distance 27 is less than a tube diameter 31, and preferably on a same order as the tube separation distance 38 between adjacent pairs of tubes 21.

Another aspect of the disclosure relates to each of the tubes 21 being adjacent to at least three other tubes 21. The tubes that are not part of the perimeter set of tubes 26 are each surrounded by six tubes according to a hexagonal packing structure. Although this structure is preferable such that the perimeter set of tubes 26 can take on a hexagonal shape, other shapes could still fall within the intended scope of the invention if the internal wall of the housing 14 is shaped to be a small gap distance with regard to the perimeter set of tubes 26. However, by using the hexagonal shape, planar wall segments that are parallel to one another can make up opposite sides of the internal wall 22 generally. Opposite planar wall segments of the internal wall 22 partially define the flow direction changing windows 30. In the illustrated embodiment, the windows have a window width 36 that is greater than the cavity height 42. As such, the windows are adjacent the longer sides of the bundle perimeter 26.

The tube bundle 20 also has some specific geometry that are aspects of the preferred embodiment. These include the fact that the tube bundle 20 includes an odd number of tube rows 33 that are sequentially arranged along a height dimension 42. One of the tube rows 34 is longer than all of the other tube rows.

Figure 5:
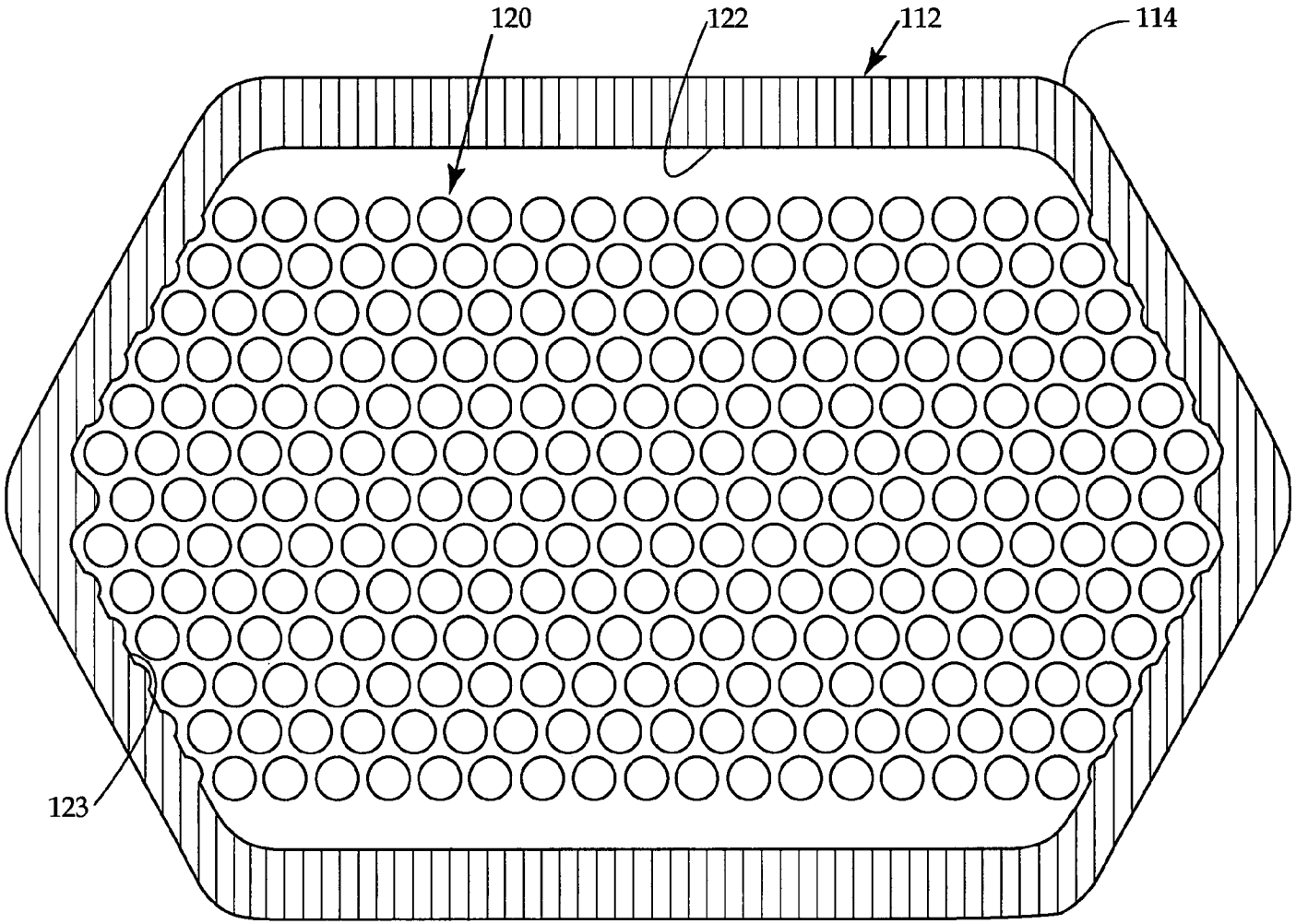
FIG. 5 is an end diagrammatic view a heat exchanger of according to another embodiment.

Referring now to FIG. 5, a heat exchanger 112 according to another embodiment is illustrated. In this embodiment, housing 114 includes an annular internal wall 122 that includes an irregular surface 123 to maintain a tight gap distance with tube bundle 120. This structure may go further in encouraging fluid flow between the tubes rather than around the tube bundle adjacent the irregular portion 123 of annular wall 122. Thus, those skilled in the art will appreciate that the present invention contemplates internal wall shapes that differ greatly from a plane as shown in the FIGS. 1–4 embodiments.

INDUSTRIAL APPLICABILITY

The present disclosure applies to virtually any heat exchanging application in which a housing contains a tube bundle, and which together define a serpentine flow path through the housing. Although the present invention has been illustrated as including a housing 14 with an annular internal wall 22 that has a uniform cross section along its length, those skilled in the art will appreciate that the present invention could find potential application to different shaped housings as well. By utilizing a relatively small gap distance 27 along with a relatively large window distance 28, the flow is made more smooth through the heat exchanger by avoiding a flow restriction where the flow reverses direction at the windows 30. Also, the heat exchanging performance is enhanced since the relatively small gap distance 27 encourages fluid flow through this central portion of the tube bundle 20 rather than along the outside edge of the perimeter bundle 26, thus improving heat transfer between fluids inside and outside tubes 21. In fact, by utilizing this geometrical strategy, the present invention can potentially match or exceed the performance of a counterpart prior art heat exchanger having a circular cross section and as many as 10% or more tubes over that of the present heat exchanger. Thus, the present heat exchanger can allow for a possible improvement in performance while also potentially allowing for a simultaneous reduction in cost.

One strategy for implementing the present invention could be to start out with a heat exchanger design having a prior art circular cross sectional shape and determining a number of tubes necessary for that given application. Next, the number of tubes is reduced by 10–15% and then the tube bundle is reshaped to have a relatively small gap distance along the internal wall except where the flow direction changing windows are. Generally, the bundle height to width ratio can be optimized for some preferred combination of pressure drop through the heat exchanger and heat rejection capability. In addition, the separation distance between baffles, the separation distance 38 between adjacent tubes 21, and the size of the window openings 30 are preferably combined in a manner such that a flow area at any given point in the heat exchanger 12 remains somewhat constant so that the fluid does not speed up and slow down as it passes through the heat exchanger 12, causing an excessive pressure drop.

It should be understood that the above description is intended for illustrative purposes only, and is not intended to limit the scope of the present invention in any way. For instance, although the preferred embodiment of the present invention shows the baffles 23 as being oriented parallel to one another and perpendicular to tubes 21, those skilled in the art will appreciate that the baffles could take on other orientations in order to alter and/or improve at least one of heat rejection performance and/or pressure drop performance through the heat exchanger 12. In addition, although the internal wall of housing 14 includes six planar wall segments connected by radius portions, the internal wall could take on a substantially irregular shape (such as FIG. 5) in order to adjust window 30 opening shape and/or adjust the gap distance 27 to encourage more flow between tubes 21 rather than between tubes 21 and internal wall 22. Thus, those skilled in the art will appreciate that other aspects, objects, and advantages of the invention can be obtained from a study of the drawings, the disclosure and the appended claims.

What is claimed is:

1. A heat exchanger comprising:

a housing having an annular internal wall that defines a portion of a heat exchanging cavity;

a tube bundle positioned in said housing and including a plurality of tubes arranged in a hexagonal packing structure and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows; and said window distance is greater than said gap distance.

2. The heat exchanger of claim 1 wherein said bundle perimeter is oblong.

3. The heat exchanger of claim 2 wherein said internal wall includes a pair of planar wall segments that are parallel with respect to one another; and said windows are partially defined by said pair of planar wall segments.

4. The heat exchanger of claim 3 wherein said heat exchanging cavity has a cavity width and a cavity height that are uniform along a cavity length.

5. The heat exchanger of claim 4 wherein said gap distance is uniform for a segment of said bundle perimeter corresponding to a plurality of adjacent tubes of said perimeter set of tubes; and said window distance is uniform for a segment of said bundle perimeter corresponding to a different plurality of adjacent tubes of said perimeter set of tubes.

6. An engine having an oil cooler according to the heat exchanger of claim 5; and said window distance is greater than said gap distance.

7. The heat exchanger of claim 1 wherein the internal wall associated with the gap distance has a non-planar irregular surface.

8. The heat exchanger of claim 1 including a separation distance between baffles, a separation distance between adjacent tubes and a window opening size have a relationship corresponding to a flow area at any given point in the heat exchanger.

9. An engine having an oil cooler according to the heat exchanger of claim 1.

10. The heat exchanger of claim 1 wherein said bundle perimeter is oblong.

11. The heat exchanger of claim 1 wherein said gap distance is less than a diameter of one of said tubes.

12. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said gap distance is uniform for a segment of said bundle perimeter corresponding to a plurality of adjacent tubes of said perimeter set of tubes.

13. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said window distance is uniform for a segment of said bundle perimeter corresponding to a plurality of adjacent tubes of said perimeter set of tubes.

14. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said bundle perimeter has a hexagonal shape.

15. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said housing is one-piece, homogenous and includes one of aluminum and iron; and said tubes are identical lengths of copper tubing.

16. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said internal wall includes a pair of planar wall segments that are parallel to one another; and said windows are partially defined by said planar wall segments.

17. The heat exchanger of claim 16 wherein said bundle perimeter has a hexagonal shape that is also oblong.

18. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows; said window distance is greater than said gap distance; and said windows have a window width that is greater than said cavity height.

19. A heat exchanger comprising:

a housing having an annular internal wall that defines a portion of a heat exchanging cavity;

a tube bundle positioned in said housing and including a plurality of tubes and a plurality of baffles;

said internal wall and said tube bundle defining a serpentine flow path that includes a plurality of flow direction changing windows;

said plurality of tubes including a perimeter set of tubes that define a bundle perimeter that is separated from said internal wall by a window distance at said windows, and separated by a gap distance away from said windows;

said window distance is greater than said gap distance; and said tube bundle includes an odd number of tube rows sequentially arranged along a height dimension; and one of said tube rows is longer than all other ones of said tube rows.

* * * * *